US011408114B2

(12) United States Patent
Kwon et al.

(10) Patent No.: US 11,408,114 B2
(45) Date of Patent: Aug. 9, 2022

(54) APPARATUS FOR TREATING LAUNDRY

(71) Applicant: LG Electronics Inc., Seoul (KR)

(72) Inventors: Yongwoo Kwon, Seoul (KR); Hyeonsik Lee, Seoul (KR); Taegyu Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 186 days.

(21) Appl. No.: 16/779,038

(22) Filed: Jan. 31, 2020

(65) Prior Publication Data

US 2020/0248378 A1 Aug. 6, 2020

(30) Foreign Application Priority Data

Feb. 1, 2019 (KR) ..... 10-2019-0013884
Apr. 19, 2019 (KR) ..... 10-2019-0046098

(51) Int. Cl.
*D06F 39/02* (2006.01)
*D06F 37/22* (2006.01)
(Continued)

(52) U.S. Cl.
CPC ..... *D06F 39/028* (2013.01); *D06F 37/22* (2013.01); *D06F 37/266* (2013.01); *D06F 39/02* (2013.01); *D06F 39/088* (2013.01)

(58) Field of Classification Search
CPC ..... D06F 37/266; D06F 39/02; D06F 39/028; D06F 39/088
See application file for complete search history.

(56) References Cited

U.S. PATENT DOCUMENTS 5,375,438 A 12/1994 Babuin
5,588,313 A * 12/1996 Hildebrand ..... D06F 25/00 68/17 R
(Continued)

FOREIGN PATENT DOCUMENTS

CN 202023088 11/2011
CN 104011281 8/2014
(Continued)

OTHER PUBLICATIONS

European Extended Search Report in European Patent Application No. 20154759.3, dated May 26, 2020, 8 pages.
(Continued)

*Primary Examiner* — Joseph L. Perrin
(74) *Attorney, Agent, or Firm* — Fish & Richardson P.C.

(57) ABSTRACT

A laundry treating apparatus includes a cabinet having an entrance and a door, a tub having a tub entrance, a drum within the tub having a drum entrance, an insulating part having a first fixing body, a second fixing body, a connecting body connecting the first and second fixing bodies together to form a space for storing liquid therebetween, and an inflow pipe through the first fixing body, a storage part within the cabinet to provide a space for storing detergent therein, a storage part connecting pipe discharging the detergent of the storage part, an insulating part connecting pipe connected to the inflow pipe, a trap forming pipe between the storage part connecting pipe and the insulating part connecting pipe, and a decelerating part provided to the insulating part connecting pipe to decelerate a flow speed of water moving from the trap forming pipe to the insulating part connecting pipe.

16 Claims, 15 Drawing Sheets

(51) Int. Cl.
*D06F 39/08* (2006.01)
*D06F 37/26* (2006.01)

(56) References Cited

U.S. PATENT DOCUMENTS

| | | | | |
|---|---|---|---|---|
| 2009/0090139 | A1* | 4/2009 | Deppermann | D06F 39/02 68/17 A |
| 2014/0299164 | A1* | 10/2014 | Zhang | D06F 35/008 134/34 |
| 2014/0352363 | A1* | 12/2014 | Kim | D06F 39/088 68/140 |
| 2015/0013396 | A1 | 1/2015 | Ayhaner et al. | |
| 2015/0114045 | A1* | 4/2015 | Bolduan | D06F 39/02 68/17 R |
| 2018/0187361 | A1* | 7/2018 | Son | D06F 39/028 |
| 2018/0282931 | A1* | 10/2018 | Kim | D06F 39/028 |

FOREIGN PATENT DOCUMENTS

| | | | | |
|---|---|---|---|---|
| CN | 104011282 | | 8/2014 | |
| CN | 104011283 | | 8/2014 | |
| CN | 104781464 | | 7/2015 | |
| DE | 102009029523 | | 3/2011 | |
| JP | H11114286 | | 4/1999 | |
| JP | 2004-313318 | | 11/2004 | |
| WO | WO-2017057940 | A1 * | 4/2017 | D06F 39/028 |

OTHER PUBLICATIONS

AU Office Action in Australian Appln. No. 2020200745, dated Dec. 8, 2020, 9 pages.

Office Action in Chinese Appln. No. 202010078520.X, dated Mar. 3, 2022, 10 pages (with English translation).

* cited by examiner

APPARATUS FOR TREATING LAUNDRY

CROSS-REFERENCE TO RELATED APPLICATIONS

This application claims the benefit of earlier filing date and right of priority to Korean Application No. 10-2019-0013884, filed on Feb. 1, 2019, and Korean Application No. 10-2019-0046098, filed on Apr. 19, 2019, the contents of which are hereby incorporated by reference herein in their entirety.

BACKGROUND OF THE DISCLOSURE

Field of the Disclosure

The present disclosure relates to a laundry treatment machine, and more particularly, to an apparatus for treating laundry.

Discussion of the Related Art

Generally, a laundry treating apparatus conceptually includes a laundry washing device, a laundry drying device and a device capable of washing or drying laundry according to a user's selection. Some of the related art laundry treating apparatuses consist of a cabinet, a tube provided within the cabinet to store water therein, a drum rotatably provided within the cabinet to store laundry therein, a detergent storage part storing a detergent therein, and a detergent flow path guiding the detergent stored in the detergent storage part to the tub.

Generally, one end of the detergent flow path provided to the related art laundry treating apparatus is fixed to the detergent storage part and the other end is fixed to a detergent supply port provided to the tub. Namely, one end of the detergent flow path is fixed to a discharge port of the detergent storage part through a fastening member such as a clamp or the like, and the other end is also fixed to the detergent supply port through a clamp. Yet, when the detergent flow path fixed to the detergent storage part and the tub through the clamp is assembled, a considerable time is required disadvantageously.

Meanwhile, the detergent flow path provided to the related art laundry treating apparatus may be provided with a trap for interrupting the connection between the tub and the detergent storage part. The trap provided to the detergent flow path has an effect of interrupting to prevent the foam in the tub from being discharged into the detergent storage part during a washing. However, when a door opens an entrance provided to the cabinet, if a pressure inside the tub is lowered, water stored in the trap of the detergent flow path may be discharged into the tub, thereby causing a problem that a user doubts whether the detergent storage part or the detergent flow path is damaged or broken.

SUMMARY OF THE DISCLOSURE

Accordingly, embodiments of the present disclosure are directed to an apparatus for treating laundry that substantially obviates one or more problems due to limitations and disadvantages of the related art.

One object of the present disclosure is to provide an apparatus for treating laundry, by which the assembly of a detergent flow path for guiding a detergent to a tub is simple.

Another object of the present disclosure is to provide an apparatus for treating laundry, by which leakage prevention of a detergent flow path is facilitated.

Another object of the present disclosure is to provide an apparatus for treating laundry, by which discharging the water stored in a trap formed in a detergent flow path into a tub due to an internal pressure change of tub is minimized.

Another object of the present disclosure is to provide an apparatus for treating laundry, by which water moving to a tub from a trap due to an internal pressure change of the tub is guided to a cabinet entrance and a tub entrance.

Further object of the present disclosure is to provide an apparatus for treating laundry, by which a flow of water moving to an insulating part from a water trap formed between a detergent flow path and a tub is not externally confirmed when a door opens an entrance.

Technical tasks obtainable from the present disclosure are non-limited by the above-mentioned technical tasks. And, other unmentioned technical tasks can be clearly understood from the following description by those having ordinary skill in the technical field to which the present disclosure pertains.

Additional advantages, objects, and features of the disclosure will be set forth in the disclosure herein as well as the accompanying drawings. Such aspects may also be appreciated by those skilled in the art based on the disclosure herein.

The present disclosure relates to a laundry treating apparatus including a detergent flow path provided with a water trap, by which discharging water stored in a water trap to a tub due to an internal pressure change of the tub generated from opening a door by a user can be minimized, and is characterized in having walls configured to decelerate a flow speed of liquid within the detergent flow path.

To achieve these objects and other advantages and in accordance with the purpose of the disclosure, as embodied and broadly described herein, an apparatus for treating laundry according to one embodiment of the present disclosure may include a cabinet having an entrance and a door opening/closing the entrance, a tub providing a space for storing water therein and having a tub entrance provided to a surface facing a direction having the entrance located therein, a drum rotatably provided within the tub to provide a space for storing the laundry therein and having a drum entrance provided to the surface facing the direction having the entrance located therein, an insulating part having a first fixing body in a cylindrical shape fixed to the entrance, a second fixing body in a cylindrical shape fixed to the tub entrance, a connecting body connecting the first and second fixing bodies together to form a space for storing liquid therein between the first fixing body and the second body, and an inflow pipe perforating the first fixing body, a storage part provided within the cabinet to provide a space for storing detergent therein, a storage part connecting pipe discharging the detergent of the storage part, an insulating part connecting pipe connected to the inflow pipe, a trap forming pipe forming one of a P-trap, a U-trap and an S-trap between the storage part connecting pipe and the insulating part connecting pipe, and a decelerating part provided to the insulating part connecting pipe to decelerate a flow speed of water moving from the trap forming pipe to the insulating part connecting pipe.

The trap forming pipe and the insulating part connecting pipe may be configured to form an angle between 90 and 120 degrees in a plane side by side with a floor surface of the cabinet.

The cabinet may include a front panel having the entrance and forming a front side, a rear panel forming a rear side, and first and second lateral panels connecting the front panel and the rear panel together, the insulating part connecting pipe may be parallel to a width direction of the front panel, and the trap forming pipe may be parallel to a width direction of the first lateral panel.

The insulating part connecting pipe may include a curved part connected to the trap forming part and located on an edge having the front panel and the first lateral panel coupled together thereon, a horizontal part extending from the curved part along the width direction of the front panel, and an inclined part connecting the horizontal part and the inflow pipe together and inclined from one end of the horizontal part toward a floor surface of the cabinet and the decelerating part may include a first decelerating wall and a second decelerating wall provided within the curved part to form a zigzagged flow path.

The first decelerating wall may be provided to a surface having a big curvature radius in a curved surface formed by the curved part along a height direction of the cabinet and the second decelerating wall may be provided to a surface having a small curvature radius in the curved surface formed by the curved part along the height direction of the cabinet.

The first decelerating wall may be provided to a surface having a small curvature radius in a curved surface formed by the curved part along a height direction of the cabinet and the second decelerating wall may be provided to a surface having a big curvature radius in the curved surface formed by the curved part along the height direction of the cabinet.

The first decelerating wall may be provided to a location closer to the trap forming part than the horizontal part in a space provided by the curved part and the second decelerating wall may be provided to a location closer to the horizontal part than the trap forming part in the space provided by the curved part.

The apparatus may further include a third decelerating wall projected from a floor surface of the horizontal part toward the height direction of the cabinet.

The apparatus may further include a fourth decelerating wall projected from a floor surface of the inclined part toward the height direction of the cabinet.

A top end of the first decelerating wall may be spaced apart from a top side of the curved part and a bottom end of the first decelerating wall may be spaced apart from a bottom side of the curved part.

A cut portion provided along a width direction of the first decelerating wall may be provided to at least one of a top end and a bottom end of the first decelerating wall.

The first decelerating wall may include a top wall connected to a top side of the curved part and a bottom wall fixed to a floor surface of the curved part and having a width different from that of the top wall.

The second decelerating wall may include a second top wall connected to a top side of the curved part and a second bottom wall fixed to a floor surface of the curved part and having a width different from that of the second top wall.

Accordingly, the present disclosure provides the following effects and/or advantages.

First of all, the assembly of a detergent flow path for guiding a detergent to a tub is simple.

Secondly, leakage prevention of a detergent flow path is facilitated.

Thirdly, discharging the water stored in a trap formed in a detergent flow path into a tub due to an internal pressure change of tub is minimized.

Fourthly, water moving to a tub from a trap due to an internal pressure change of the tub is guided to a cabinet entrance and a tub entrance.

Fifthly, a flow of water moving to an insulating part from a water trap formed between a detergent flow path and a tub is not externally confirmed when a door opens an entrance.

Effects obtainable from the present disclosure may be non-limited by the above mentioned effect. And, other unmentioned effects can be clearly understood from the following description by those having ordinary skill in the technical field to which the present disclosure pertains.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. The above and other aspects, features, and advantages of the present disclosure will become more apparent upon consideration of the following description of preferred embodiments, taken in conjunction with the accompanying drawing figures. In the drawings.

DETAILED DESCRIPTION OF THE DISCLOSURE

Figure 1:
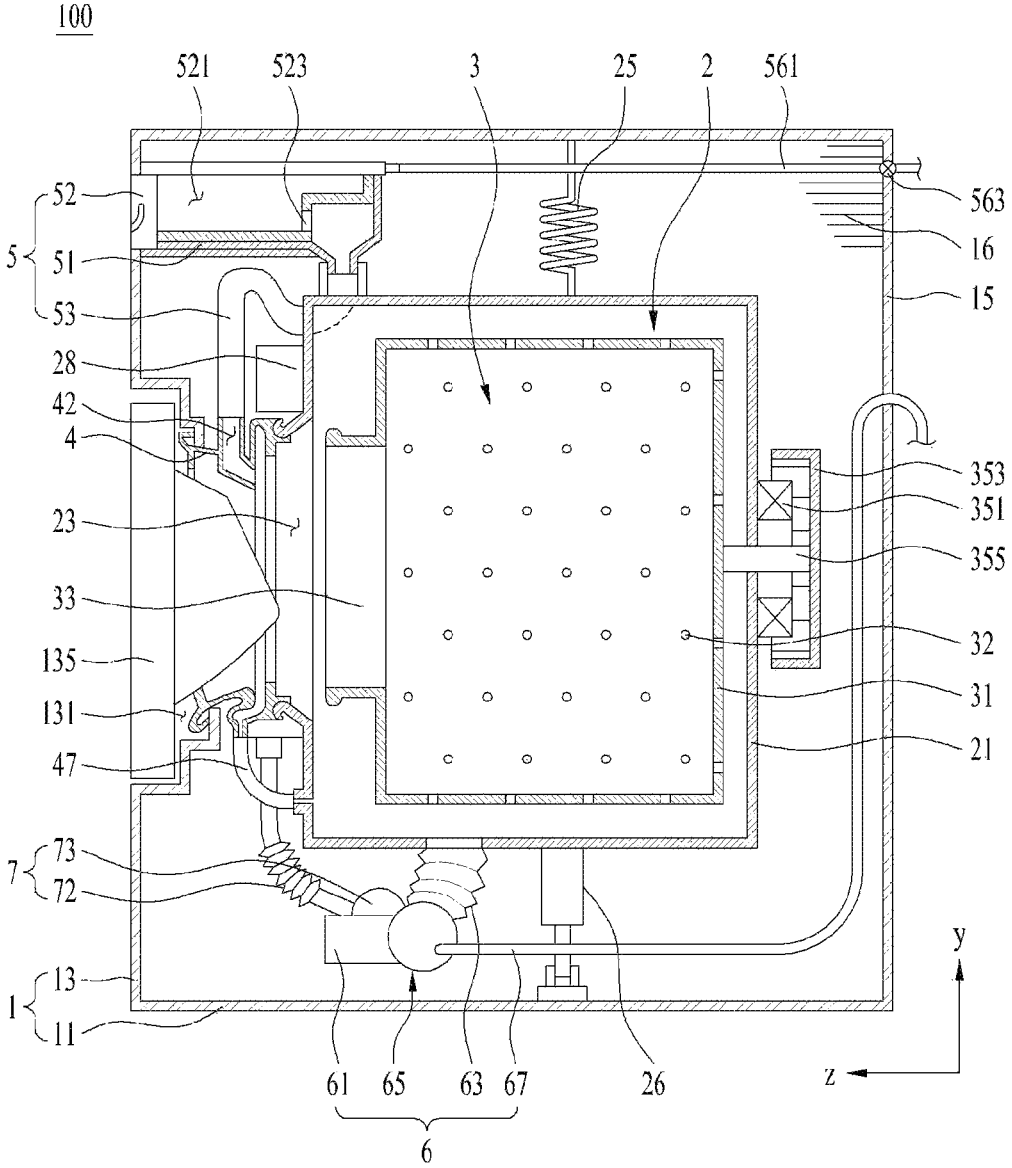
FIG. 1 and FIG. 2 are diagrams showing one example of a laundry treating apparatus.

Reference will now be made in detail to the preferred embodiments of the present disclosure, examples of which are illustrated in the accompanying drawings, to facilitate those having ordinary skill in the art to implement the disclosure. Wherever possible, the same reference numbers will be used throughout the drawings to refer to the same or like parts.

A laundry treating apparatus 100 includes a cabinet 1, a tub 2 provided within the cabinet 1 to store water therein, a drum 3 rotatably provided within the tub 2 to store laundry therein, and a detergent supply part 5 supplying a detergent to the tub 2.

The cabinet 1 may include a base 11 forming a bottom side of the laundry treating apparatus, a front panel 13 forming a front side of the laundry treating apparatus, a rear panel 15 forming a rear side of the laundry treating apparatus, a first lateral panel 16 and a second lateral panel (not shown) respectively forming lateral sides of the laundry treating apparatus, and a top panel forming a top side of the laundry treating apparatus. The front panel 13 and the rear panel 15 may be fixed to the base 11, and the first lateral panel 16 and the second lateral panel may be configured to connect the front panel and the rear panel to each other by being fixed to the base 11.

An entrance 131 configured to allow an inside of the cabinet to communicate with an outside is provided to the front panel 13 and may be configured to opened/closed by a door 135 rotatably provided to the front panel 13.

The tub 2 may include a tub body 21 in a hollow cylindrical shape, and a tub entrance 23 is provided to a front side of the tub body. The tub entrance 23 is connected to the entrance 131 through an insulating part 4, and a specific structure of the insulating part will be described later.

Figure 2:
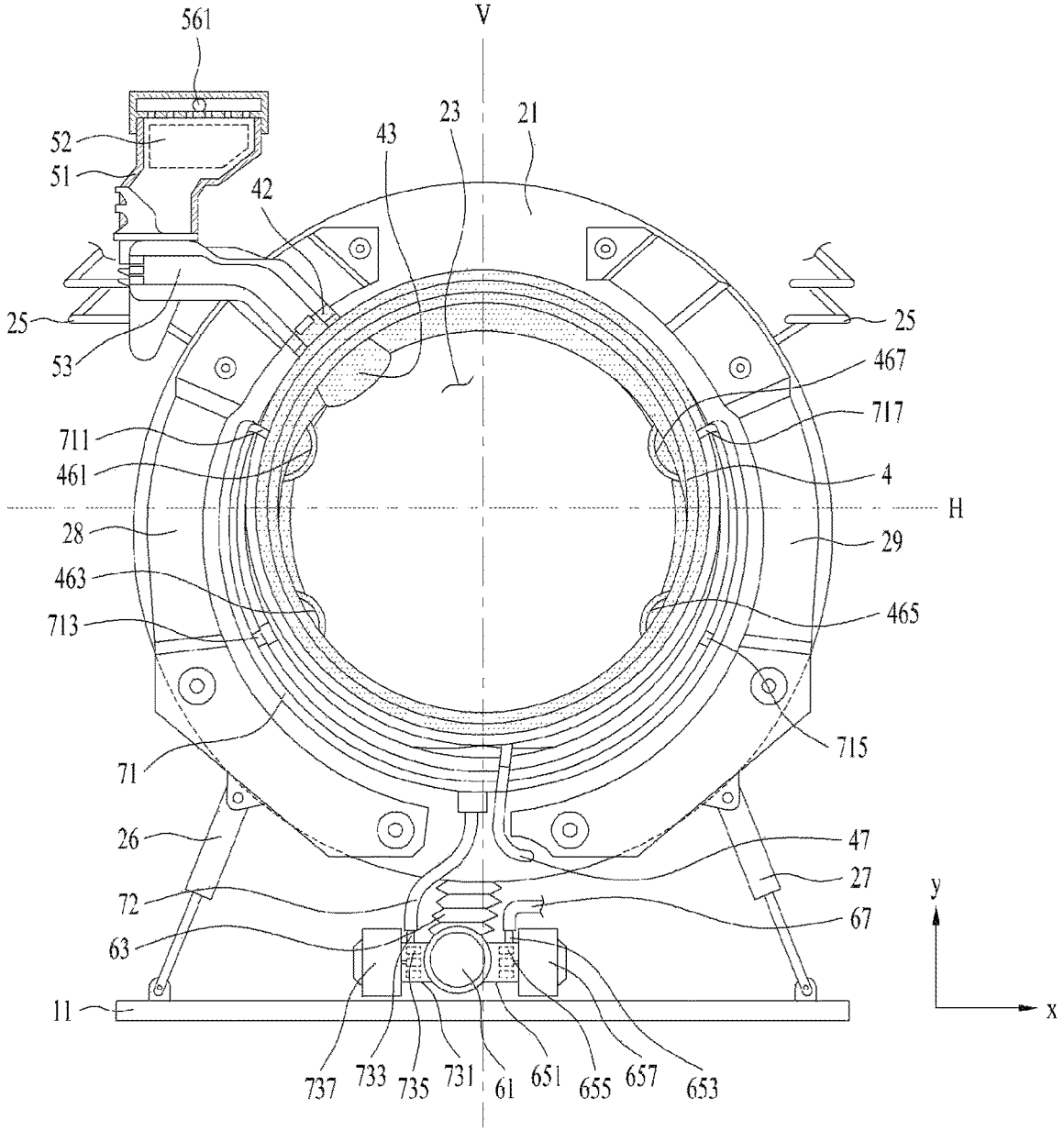

The tub body 21 may be fixed to an inside of the cabinet 1 through a tub support. As shown in FIG. 2, the tub support may include a spring 25 fixing a region of a circumference of the tub body 21, which is located above a horizontal line H passing through a rotation center of the drum, to the cabinet 1 and a damper fixing a region of the circumference of the tub body 21, which is located below the horizontal line H, to the cabinet 1.

The damper may include a first damper 26 located on a region of the circumference of tub body 21, which is located on a left side of a vertical line V passing through the rotation center of the drum, and a second damper 27 located on a region of the circumference of the tub body 21, which is located on a right side of the vertical line V.

A front weight part configured to increase a weight of the tub body 21 may be further provided to a front side of the tub body 21. The front weight part may include a first weight balancer 28 fixed in a space located on the left side of the vertical line V in a space provided by the front side of the tub body and a second weight balancer 29 fixed in a space located on the right side of the vertical line V in the space provided by the front side of the tub body.

If the weight of the tub body 21 is increased through the front weight part, the tub body 21 absorbs larger vibration. Hence, the laundry treating apparatus can minimize the transmission of vibration, which is generated from the rotation of the drum 3, to the cabinet.

As shown in FIG. 1, the drum 3 includes a drum body 31 rotatable within the tub body 21. The drum body 31 has a hollow cylindrical shape, and drum perforated holes 32 are provided to a circumferential side, a front side and a rear side of the drum body 31 to allow an inside of the drum body to communicate with an inside of the tub body. And, a drum entrance 33 is provided to a surface (i.e., a front side of the drum) facing the entrance 11 in a space provided by the drum body 31.

The drum body 31 is rotated by a drum drive part, which may include a stator 351 fixed to a backside of the tub body 21 to generate a rotating field, a rotor 353 located outside of the tub body 21 so as to be rotated by the rotating field, and a rotation shaft 355 perforating the rear side of the tub body 21 to connect the rotor 353 to the drum body 31.

The insulating part 4 connecting the entrance 131 and the tub entrance 23 to each other is a means for attenuating vibration of the tub body 21 transmitted to the cabinet 1 as well as preventing the water stored in the tub body 21 from being discharged to the cabinet 1 through the tub entrance 23.

Figure 3:
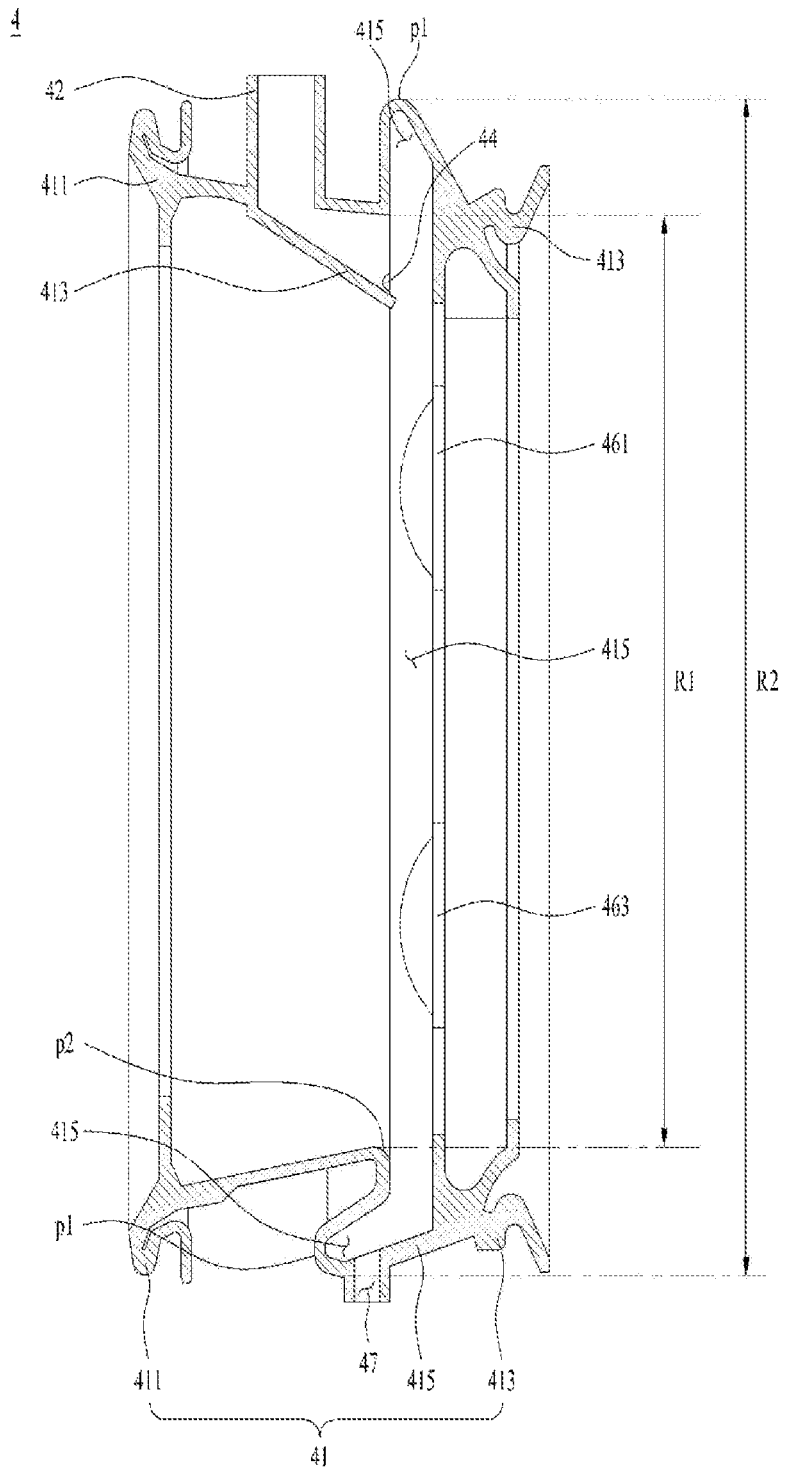
FIG. 3 is a diagram showing one example of an insulating part provided to a laundry treating apparatus.

As shown in FIG. 3, the insulating part 4 includes an insulating body 41 formed of an elastic material (e.g., rubber, etc.) to connect the entrance 131 and the tub entrance 23 to each other. The insulating body 41 may include a first fixing body 411 of a cylindrical shape having one end fixed to the entrance 131, a second fixing body 413 of a cylindrical shape having the other end fixed to the tub entrance 23, and a connecting body 415 connecting a free end of the first fixing body and a free end of the second fixing body to each other.

A diameter R2 of the free end of the second fixing body 413 is preferably set linger than a diameter R1 of the free end of the first fixing body 411, and a length of the first fixing body 411 is preferably set to have the free end of the first fixing body 411 inserted in the second fixing body 413. The connecting body 415 connecting the two free ends together is preferably configured to include at least one inflection point (inflection surface).

FIG. 3 shows one example of a case that two inflection points P1 and P2 are provided to a top space (i.e., a space located above a horizontal line passing through a rotation center of the drum) of the connecting body and a bottom space of the connecting body, respectively. If one or more inflection points are provided to the connecting body 415, transmission of vibration of the tub body 21 to the cabinet 1 can be effectively interrupted and water remaining on the insulating body 41 can be concentrated in the bottom space of the connecting body 415. Since water having flown into the connecting body 415 will be concentrated in the bottom space of the connecting body by gravity, a volume of the bottom space of the connecting body is set greater than that of the top space of the connecting body so as to be advantageous in removing the remaining water.

In order that the water having flown into the connecting body 415 can move to the tub body 21, a communicating pipe 47 configured to enable an inside of the connecting body to communicate with the tub body 21 may be further provided to the insulating part 4.

In order that one end of the communicating pipe 47 is connected to a lowest point and that the other end of the communicating pipe 47 is located below the lowest point of the connecting body 415, the communicating pipe 47 is preferably fixed to a front side of the tub body 21. Thus, the water within the connecting body 415 can be discharged by gravity.

As shown in FIG. 1, the water stored in the tub body 21 is externally discharged from the cabinet 1 through a drain part 6.

The drain part 6 may include a chamber 61 providing a space for storing water therein, a first drain pipe 63 guiding the water of the tub body 21 to the chamber 61, and a drain pump 65 moving the water, which has flown into the chamber 61, to a second drain pipe 67. And, the second drain pipe 67 is a means for guiding the water discharged from the drain pump 65 to an outside of the cabinet 1. Moreover, the highest point of the second drain pipe 67 may be configured to pass through a point higher than a lowest end of the tub entrance 23 or a point higher than a second bent portion P2 provided to a bottom area of the connecting body.

As shown in FIG. 2, the drain pump may include a first housing 651 configured to communicate with the chamber 61 so as to provide a space for storing water therein, a first impeller 655 configured rotatable within the first housing, a first impeller motor 657 rotating the first impeller, and a first discharge port 653 configured to perforate a circumferential surface of the first housing so as to have the second drain pipe 67 fixed thereto.

In order to shorten a wash time or raise a wash power, the laundry treating apparatus 100 may further include a spray part 7 configured to spray the water stored in the tub body 21 toward the drum entrance 33.

The spray part 7 may include a flow path body 71 fixed to a front side of the tub body so as to be located in a space between a circumferential surface of the insulating body 41 and the front weight part 28 and 29, a supply pipe 72 guiding water to the flow path body 71, and a circulation pump 73 moving the water within the tub body 21 to the supply pipe 72.

The flow path body 71 may be configured as a flow path in a fan shape provided along a space between the insulating body 41 and the first weight balancer 28 and a space between the insulating body 41 and the second weight balancer 29.

The circulation pump 73 may include a second housing 731 configured to communicate with the chamber 61 to provide a space for storing water therein, a second impeller 735 provided within the second housing, a second impeller motor 737 configured to rotate the second impeller, and a second discharge port 733 configured to perforate a circumferential surface of the second housing to have the supply pipe 72 fixed thereto.

The flow path body 71 may be provided with a first discharge portion 711, a second discharge portion 713, a third discharge portion 715 and a fourth discharge portion 717, from which water is discharged. The first and second discharge portions 711 and 713 may be provided to the left side of the vertical line V passing through the center of the tub entrance 23 and the third and fourth discharge portions 715 and 717 may be provided to the right side of the vertical line V.

The first discharge portion 711 may be connected to a first spray guide 461 provided to the insulating body 41, the second discharge portion 713 may be connected to a second spray guide 463 provided to the insulating body 41, the third discharge portion 715 may be connected to a third spray guide 465 provided to the insulating body 41, and the fourth discharge portion 717 may be connected to a fourth spray guide 467 provided to the insulating body 41.

The guides 461, 463, 465 and 467 are the means for guiding water supplied from the discharge portions 711, 713, 715 and 717 toward a direction in which the drum entrance 43 is located, and may be configured along an inner circumferential surface of the second fixing body 413.

As shown in FIG. 1, the detergent supply part 5 provided to the laundry treating apparatus may include a case 51 provided within the cabinet 1 and a drawer drawable from the case 51.

The drawer 52 received in the case 51 may be drawn out of the cabinet 1 through a drawer exit provided to perforate the front panel 13. The drawer 52 may be configured with a polyhedron (e.g., hexahedron, etc.) having an open topside, and a storage part 521 providing a space for storing a detergent therein and a detergent discharge port 523 enabling the storage part 521 to communicate with the case 51 may be included in the drawer. The detergent discharge port 523 may be configured as a perforated hole that perforates a rear or floor side of the storage part 521 or a bell trap provided to the floor side of the storage part 521.

A water supply part supplying water to the storage part 521 is provided to the case 51, and FIG. 1 shows one example of a case that the water supply part is fixed to the top side of the case 51.

The water supply part may include a water supply pipe 561 supplying water of a water supply source to the storage part 521 and a water supply valve 563 opening or closing the water supply pipe 561 in response to a control signal of a controller (not shown). Hence, if water is supplied to the storage part 521 having a detergent stored therein through the water supply pipe 561, the detergent in the storage part 521 moves to the case 51 through the detergent discharge port 523 together with the water.

The water and detergent discharged to the case 51 may be supplied into the tub body 21 through the insulating body 41. To this end, an inflow pipe having the water and detergent flow in therethrough may be provided to the insulating part 4 and a discharge pipe 53 guiding the detergent and water to the inflow pipe 42 may be provided to the detergent supply part 5.

The inflow pipe 42 and the discharge pipe 53 may be formed of elastic material (e.g., rubber, etc.). This is to minimize the transmission of the vibration of the tub to the case 51 and the front panel 15 through the inflow pipe 42 and the discharge pipe 53.

As shown in FIG. 3, the inflow pipe 42 may include a pipe perforating a circumferential surface of the insulating body 41. In this case, a guide 43 guiding the water supplied through the inflow pipe 42 toward a direction, in which the drum entrance 33 is located, may be further provided to the circumferential surface of the insulating body 41.

Although it is preferable that the inflow pipe 42 and the discharge pipe 53 are integrally formed so as to configure a single detergent flow path, it may be almost impossible to form the inflow pipe 42 and the discharge pipe 53 into a single flow path considering the structures of the insulating part 4 and the discharge pipe 53. As it is difficult to form the inflow pipe 42 and the discharge pipe 53 into the single flow path, the laundry treating apparatus connects the inflow pipe 42 and the discharge pipe 53 together using a connector 8.

If the inflow pipe 42 and the discharge pipe 53 are formed of elastic material such as rubber or the like, the connector 8 is preferably formed of plastic material, etc. This is to minimize the possibility of separation of the inflow pipe 42 and the discharge pipe 53 from the connector 8 using the frictional force between rubber and plastic.

Figure 4:
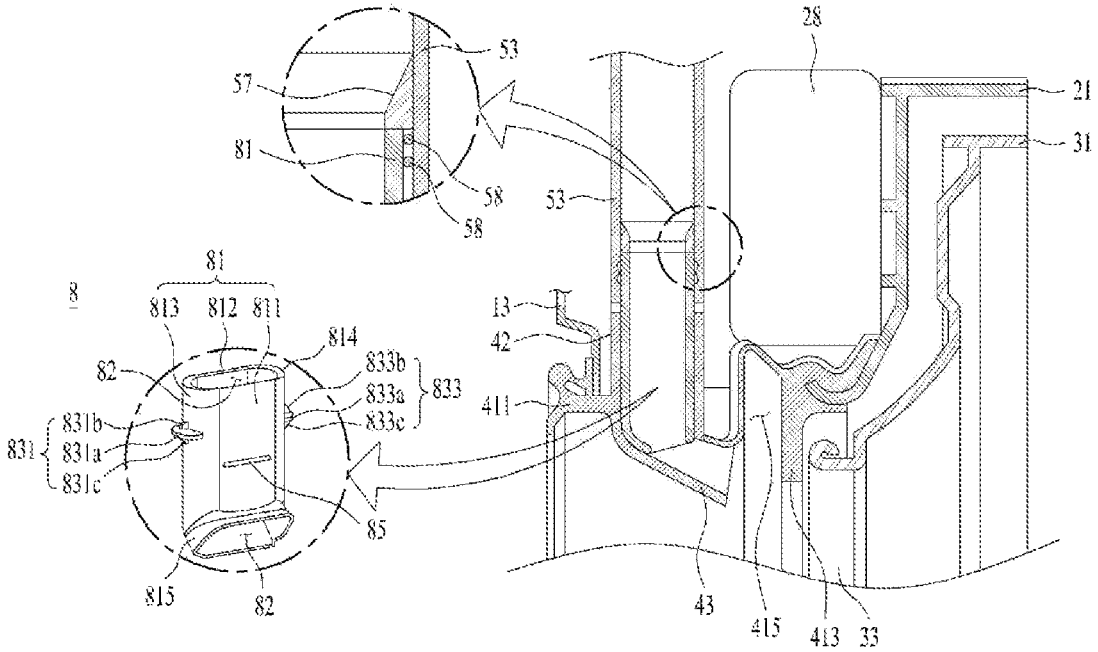
FIGS. 4 to 6B are diagrams showing one example of a connector provided to a laundry treating apparatus.

As shown in FIG. 4, the connector 8 may include a connector body 81 in a cylindrical shape having one end inserted in the discharge pipe 53 and the other end inserted in the inflow pipe 42 and a perforated hole 82 configured to perforate the connector body 81 so as to guide a fluid within the discharge pipe 53 to the inflow pipe 42.

The connector body 81 may be configured in a shape including a first face 811, a second face 811 disposed to oppose the first face 811, a third face 813 connecting one end of the first face 811 and one end of the second face 812 to each other, and a fourth face 814 connecting the other end of the first face 811 and the other end of the second face 812 to each other. In this case, the third face 813 and the fourth face 814 may be configured to oppose each other.

Each of the third and fourth faces 813 and 814 may be formed as a curved surface having the same curvature radius, thereby minimizing the damage caused to the discharge or inflow pipe by the edge formed at the connector body or the possibility of separation of the connector body from the discharge or inflow pipe by increasing a contact area (i.e., a frictional force). Thermal deformation by injection molding can be minimized if the thickness of two faces having the longest length among the four faces 811 to 814 is set greater than that of two faces having the shortest length, which will be described in detail later.

A bent part 815 may be provided to one of both ends of the connector body 81, which is located in a direction for insertion into the inflow pipe 42. The bent part 815 may be formed in a manner of bending a free end of the connector body 81 toward the tub entrance 23, and an inclination angle of the bent part 815 may be set equal to that of the guide 43. In this case, the bent part 815 may perform a function of preventing the connector body 81 from being separated from the insulating body 41 as well as a function of guiding water in the perforated hole 82 of the connector body to the guide 43.

The connector body 81 is fixed to the discharge pipe 53 through a fastening part 831 and 833 including a first fastening part 831 provided to the third face 813 and a second fastening part 833 provided to the fourth face 814.

The first fastening part 831 may include a first fastening projection 831*a* projected from the third face 813, a first projection first extension portion 831*b* extending from the first fastening projection 831*a* toward the discharge pipe 53 and a first projection second extension portion 831*c* extending from the first fastening projection 831*a* toward the inflow pipe 42.

The first fastening projection 831*a* is provided along a width direction (i.e., a direction toward the second face from the first face) of the third face, and the first projection first extension portion 831*b* and the first projection second extension portion 831*c* may be configured orthogonal to the fastening projection 831*a*.

The second fastening part 833 may include a second fastening projection 833*a* projected from the fourth face 814, a second projection first extension portion 833*b* extending from the second fastening projection 833*a* toward the discharge pipe 53 and a second projection second extension portion 833*c* extending from the second fastening projection 833*a* toward the inflow pipe 42.

The second fastening projection 833*a* is provided along a width direction (i.e., a direction toward the second face from the first face) of the fourth face, and the second projection first extension portion 833*b* and the second projection second extension portion 833*c* may be configured orthogonal to the fastening projection 833*a*.

Figure 5:
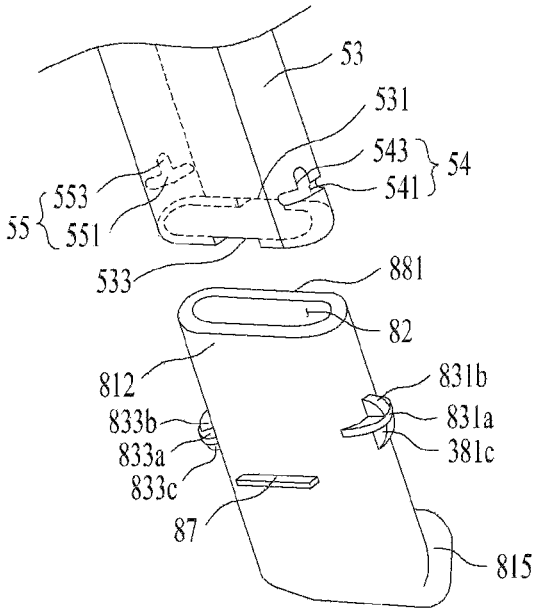
Figure 5:
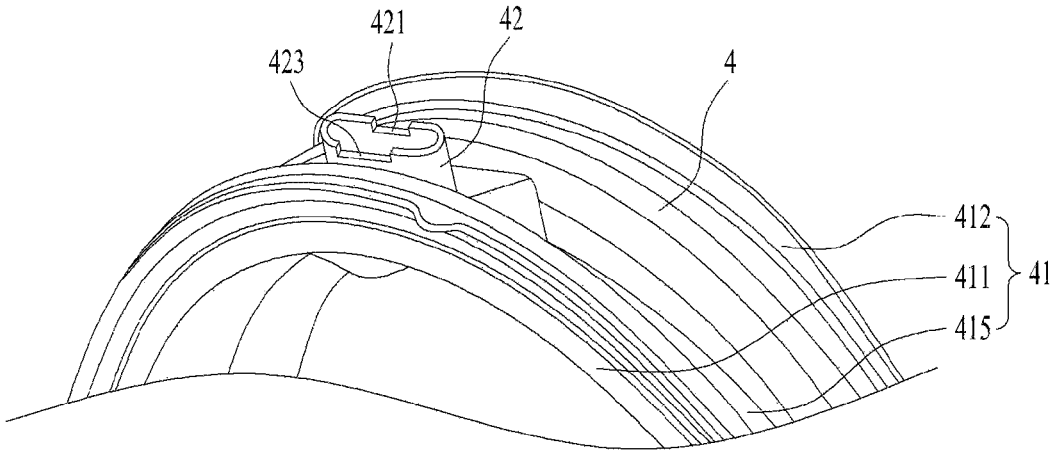

As shown in FIG. 5, a first fastening hole 54 having the first fastening projection 831 coupled thereto and a second fastening hole 55 having the second fastening projection 833 coupled thereto are provided to the discharge pipe 53.

The first fastening hole 54 may include a first slit 541 configured to penetrate the discharge pipe 53 so as to have the first fastening projection 831*a* inserted therein and a first slit extension portion 543 extending from the first slit 541 so as to have the first projection first extension portion 831*b* inserted therein. And, the second fastening hole 55 may include a second slit 551 configured to penetrate the discharge pipe 53 so as to have the second fastening projection 833*a* inserted therein and a second slit extension portion 553 extending from the second slit 551 so as to have the second projection first extension portion 833*b* inserted therein.

The first slit extension portion 543 is configured to be orthogonal to the first slit 541, and the second slit extension portion 553 is configured to be orthogonal to the second slit 551. Preferably, an inclined plane inclined downward toward the first slit extension portion 543 is provided to a front side (i.e., a side facing the discharge pipe) of the first projection first extension portion 831*b* and an inclined plane inclined downward toward the second slit extension portion 553 is provided to a front side (i.e., a side facing the discharge pipe) of the second projection first extension portion 833*b*. This is to facilitate the first projection first extension portion 831*b* and the second projection first extension portion 833*b* to be inserted in the first slit extension portion 543 and the second slit extension portion 553, respectively.

In some implementations, a height of the first projection second extension portion and a height of the second projection second extension portion 833*c* are preferably set to a length that makes an inner circumference of the discharge pipe 53 adhere closely to the first face 811 and the second face 812 of the connector body by pressurizing the discharge pipe 53. This is to minimize the risk that water is discharged into a space formed between the outer circumference of the connector body 81 and the inner circumference of the discharge pipe 53.

The connector body 81 may further include a position setting part 85/87 that enables a connection between the discharge pipe 53 and the inflow pipe 42 to be checked visually by allowing a worker to check a depth that the connector body is inserted in the discharge pipe 53 and a depth that the connector body 81 is inserted in the inflow pipe 42.

The position setting part may include a first stopper 81 (see FIG. 4) projected from the first face 811 and a second stopper 87 (see FIG. 5) projected from the second face 812. The first stopper 85 may be provided as a bar configured along a width direction of the first face 811, and the second stopper 87 may be provided as a bar configured along a width direction of the second face 812.

In this case, a first discharge pipe recess 531 and a second discharge pipe recess 533 for receiving the first stopper 85 and the second stopper 87 therein, respectively may be provided to a free end of the discharge pipe 53. And, a first inflow pipe first recess 421 and a second inflow pipe recess 423 for receiving the first stopper 85 and the second stopper 87 therein, respectively may be provided to a free end of the inflow pipe 42.

Furthermore, a connector stopper 57 provided in a ring shape to fix a position of the connector body 81 may be provided to an inner circumferential surface of the discharge pipe 53.

As shown in FIG. 4, the connector stopper 57 may be provided to the inner circumference of the discharge pipe 53 in a manner of being inclined upward forward the edge of the perforated hole 82. If the connector stopper 57 may be provided to the inner circumference of the discharge pipe 53 in a manner of being inclined upward forward the edge of the perforated hole 82, the risk of leakage into the space between the discharge pipe and the connector body can be minimized.

To minimize the risk of leakage into the space between the discharge pipe and the connector body, a sealing part 58 may be further provided to the inner circumference of the discharge pipe 53. As shown in FIG. 4, the sealing part 58 may include a ring-shaped projection projected toward the connector body from the inner circumference of the discharge pipe.

Figure 6A:
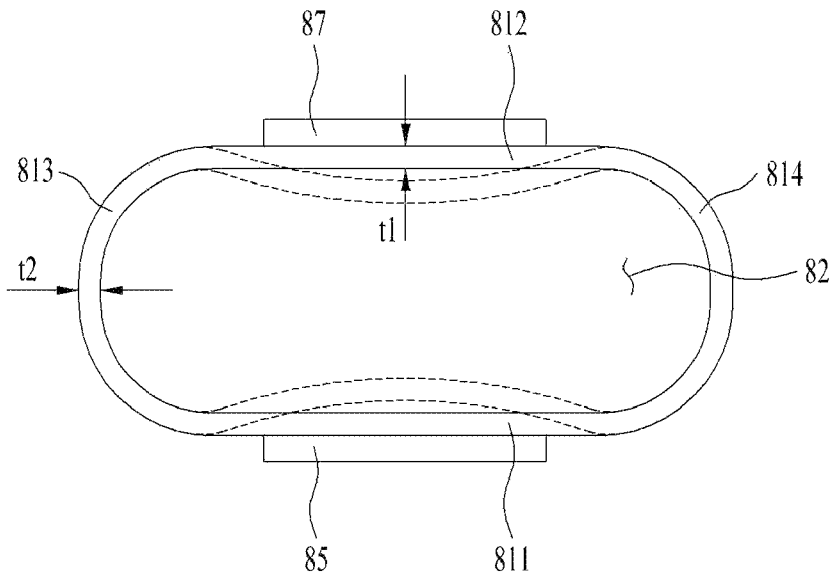

As shown in FIG. 6A, lengths of the first and second faces 811 and 812 may be set equal to each other. Lengths of the third and fourth faces 813 and 814 may be set equal to each other but smaller than that of the first face 811. In this case, if a thickness t1 of the first face is equal to a thickness t2 of the third face, it is highly probable that the first and second faces 811 and 812 will be curved toward the perforated hole 82 of the connector body.

As described above, if the connector body 81 is formed of plastic material or the like, the connector body 81 may be formed by injection molding of forming a shape of an object by injecting plastic resin into a mold and then hardening the injected plastic resin. When the connector body 81 is formed by injection molding, although the length of each of the first and second faces is set longer than that of the third or fourth face, if the thickness t1 of the first face is equal to the thickness t2 of the third face, since a hardening rate of the third and fourth faces 813 and 814 is different from that of the first and second faces 811 and 812, it is highly probable that the first and second faces 811 and 812 will be curved toward the perforated hole 82 of the connector body.

If the first and second faces 811 and 812 are curved toward the perforated hole 82, a space is formed between the discharge pipe 53 and the connector body 81. Hence, there is a risk of leakage of water, which moves s within the discharge pipe 53, into the cabinet 1. To prevent such a problem, the thickness t1 of the first face is preferably formed greater than the thickness t2 of the third face.

Figure 6B:
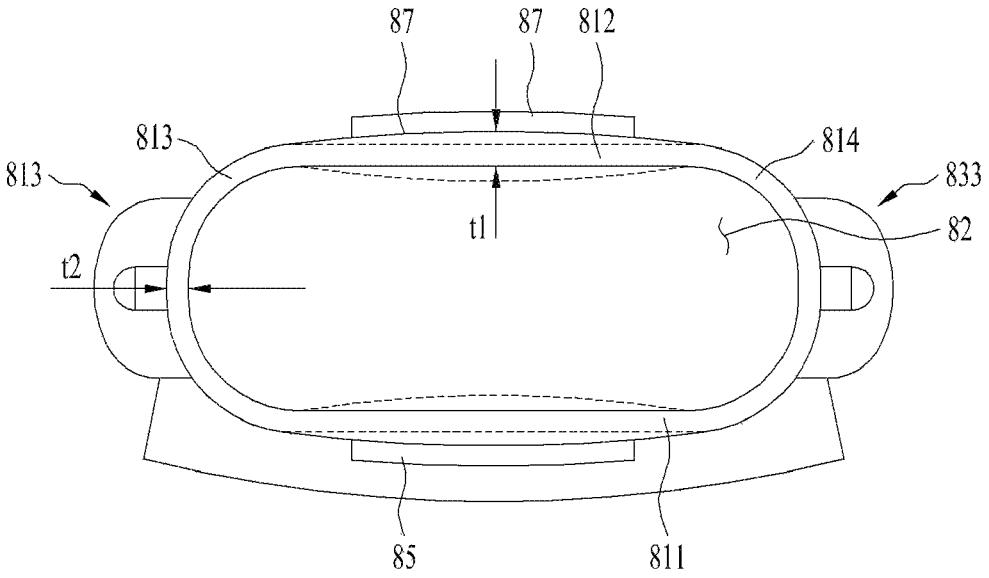

Namely, as shown in FIG. 6B, a thickness-directional cross-section of the first face 811 may be formed in a convex shape toward a direction of getting away from the center of the perforated hole 82, whereas a thickness-directional cross-section of the second face 812 may be formed in a convex shape toward a direction of getting away from the center of the perforated hole 82.

If the first and second faces 811 and 812 are formed in the shape shown in FIG. 6B, although deformation (denoted by the dotted lines in FIG. 6B) of the first and second faces 811 and 812 is generated in the course of the injection molding, the possibility of the leakage into the space between the discharge pipe 53 and the first face 811 and the space between the discharge pipe 53 and the second face 812 can be minimized.

As shown in FIG. 6B, when lengths of the first and second faces 811 and 812 are set equal to each other and lengths of the third and fourth faces 813 and 814 are set equal to each other but smaller than that of the first face 811, if the thickness t2 of the third face is set greater than the thickness t1 of the first face, the aforementioned effect may be expectable. In this case, a thickness-directional cross-section of the third face 813 may be formed in a convex shape toward a direction of getting away from the center of the perorated hole 82 and a thickness-directional cross-section of the fourth face 814 may be formed in a convex shape toward a direction of getting away from the center of the perorated hole 82.

By the connector 8 described above, the laundry treating apparatus facilitates the assembly of the discharge pipe 53 and the inflow pipe 42 and prevents the leakage effectively.

Figure 7A:
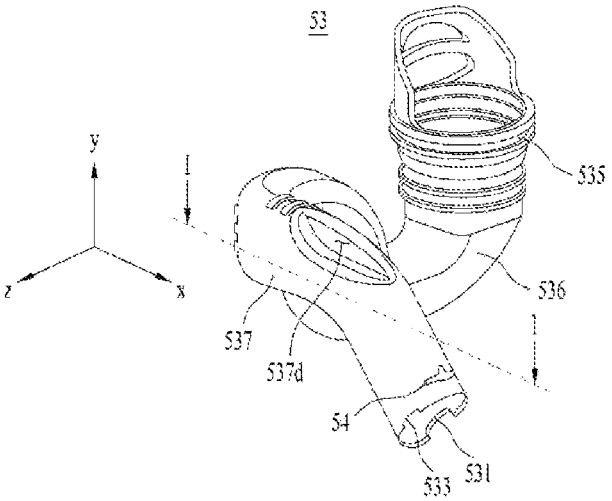
FIG. 7A to FIG. 8 are diagrams showing one example of a discharge pipe provided to a laundry treating apparatus.
Figure 7B:
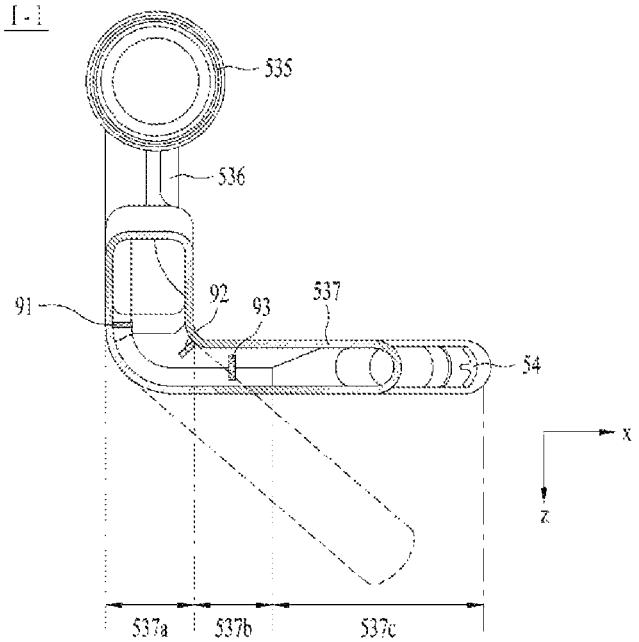

FIGS. 7A and 7B show one example of the discharge pipe 53. The discharge pipe 53 shown in FIGS. 7A and 7B may include a storage part connecting pipe 535 fixed to the case 51, an insulating part connecting pipe 535 connected to the inflow pipe 42 of the insulating part through the connector 8, and a trap forming pope 536 forming a water trap between the storage part connecting pope and the insulating part connecting pipe. A detergent discharged from the storage part 521 flows into the discharge pipe 53 through the storage part connecting pipe 535.

The trap forming pipe 5365 may be configured to form one of a P-trap, a U-trap and an S-trap and interrupt the communication between the inner space of the tub body 21 and the inner space of the case 51 through the trap forming pipe 536. Through this, the laundry treating apparatus may interrupt the movement of foam and the line within the tub body to the case 51 via the discharge pipe 53. Furthermore, when the laundry treating apparatus is used as a dryer, the trap forming pipe 536 may become a means for preventing the heated air provided to the tub body from leaking externally from the tub body through the discharge pipe 53.

According to a pressure change of an inside of the tub body 21, which is generated from opening the door 135 by a user, the water stored in the trap forming pipe 536 may be discharged to the insulating body 41. If the door 135 opens the entrance 131, a pressure within the tub body 21 is temporarily lowered, whereby the water of the trap forming pipe 536 can move to the inflow pipe 42.

As the water stored in the trap forming pipe 536 is the water remaining in the discharge pipe 53 after completion of a water or detergent supply process or a mixed liquid of water and detergent, it may cause user's misunderstanding of damage or breakage of the detergent supply part in using the laundry treating apparatus despite not causing problems related to hygiene.

To minimize such a problem, the discharge pipe 53 is further provided with a decelerating part configured to decelerate a flow speed of water moving from the trap forming pipe 536 to the insulating part connecting pipe 537.

If the speed of the water moving from the trap forming pipe 536 to the inflow pipe 42 is lowered by the decelerating part, the water will move to the connecting body 415 provided to the insulating body along a surface of the insulating part 4. Once the water moves to the connecting body 415 along the surface of the insulating part 4, a user may not be able to recognize that water is discharged from the trap forming pipe 536, whereby the user's misunderstanding of the breakage of the detergent supply part can be prevented.

As shown in FIG. 7B, in the plane (i.e., X-Z plane) side by side with a floor surface (i.e., base) 11 of the cabinet, the trap forming pipe 536 and the insulating part connecting pipe 537 is preferably configured to form an angle between 90 and 120 degrees.

If the trap forming pipe 536 projected to the floor surface of the cabinet 1 and the insulating part connecting pipe 537 projected to the floor surface of the cabinet are configured to form the angle between 90 and 120 degrees, an inflection point (e.g., flow path inflection point) will be formed at a flow path connecting the trap forming pipe 536 and the inflow pipe 42 together. And, the flow path inflection point has an effect of lowering the flow speed of the water moving from the trap forming pipe 536 to the inflow pipe 42.

The effect of the lowered flow speed is maximized if the trap forming pipe 536 and the insulating part connecting pipe 537 are configured orthogonal to each other. In this case, the insulating part connecting pipe 537 will be configured side by side with a width direction (i.e., X-axis direction) of the front panel 13 of the cabinet and the trap forming pipe 536 will be configured side by side with a width direction (i.e., Z-axis direction) of the first lateral panel 16 of the cabinet.

Figure 8:
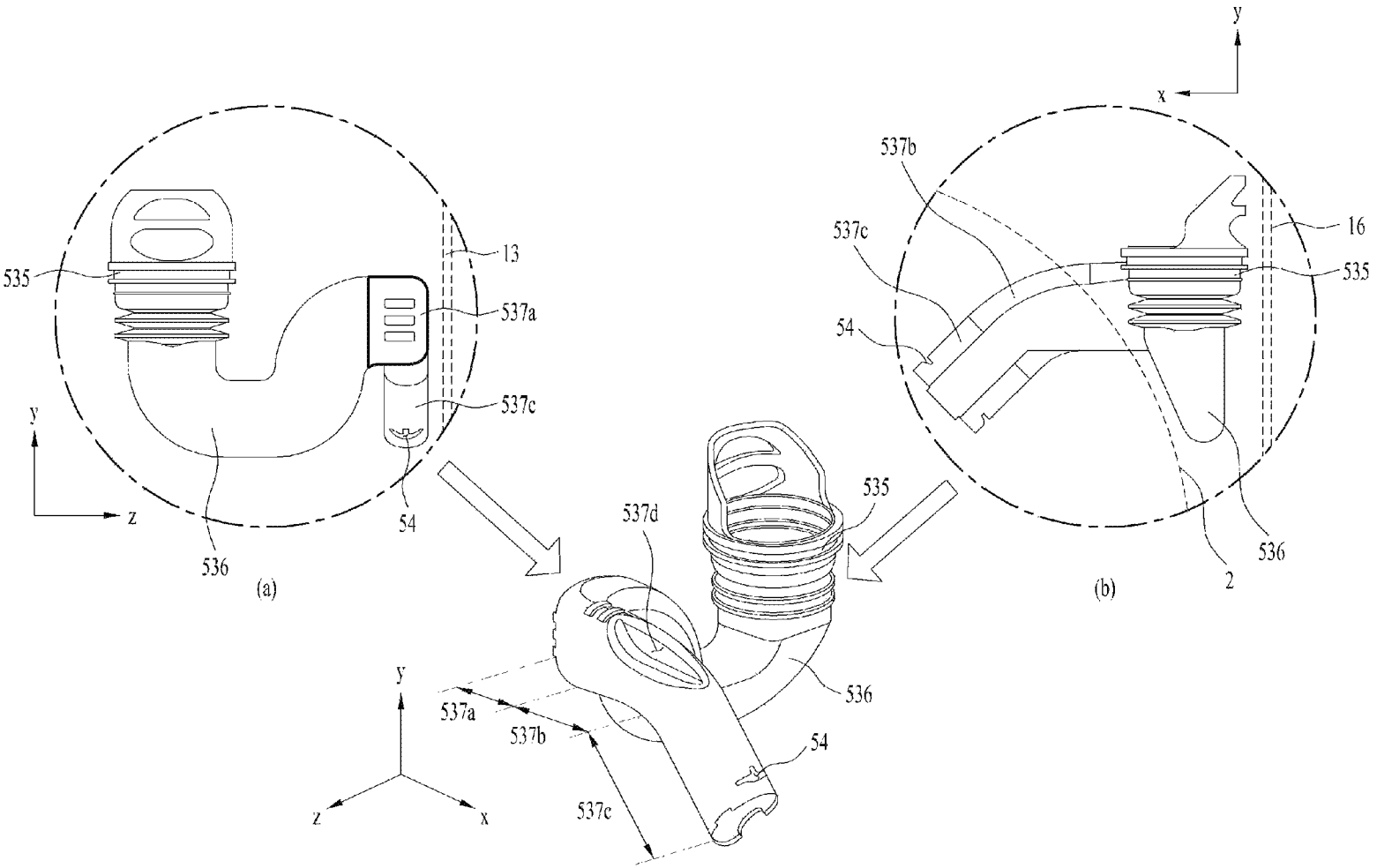

As shown in FIG. 8, the insulating part connecting pipe 537 may include a curved part 537*a* connected to the trap forming pipe 536, a horizontal part 537*b* extending from the curved part 537*a* along a width direction (i.e., X-axis direction) of the front panel 13, and an inclined part 537*c* connecting the horizontal part 537*b* and the inflow pipe 42 together.

The curved part 537*a* may be provided to be located at the edge where the front panel 14 and the first lateral panel 16 are coupled together, and the inclined part 537*c* may be configured to be inclined downward toward the floor surface 11 of the cabinet from one end of the horizontal part 537*b*.

An interference preventing part 537*d* may be further provided to a top space of the insulating part connecting pipe 537. The interference preventing part 537*d* is a means for preventing a control unit (not shown) provided within the cabinet from interfering with the insulating part connecting pipe 537. The control unit may include a Printed Circuit Board (PCB) configuring a controller. The PCB may be located within the cabinet 1 by being fixed to a top are in a space provided by the front panel 13 of the cabinet. In this case, the interference preventing part 537*d* may include a recess for receiving a bottom edge of the PCB.

As shown in FIG. 8(*b*), a width of the trap forming pipe 536 may be configured to get narrower toward the base 15 from the storage part connecting pipe 535. Namely, the trap forming pipe 536 is located in a space between the circumference of the tub 2 and the first lateral panel 16, and an interval between the tub 2 and the first lateral panel 16 gets narrower toward the base 11 from the top panel of the cabinet. FIG. 8(*b*) shows one example of a case that a width decreases as a surface of the trap forming pipe 536, which faces the circumference of the tub 2 is configured to be inclined downward toward the base 11.

Figure 9:
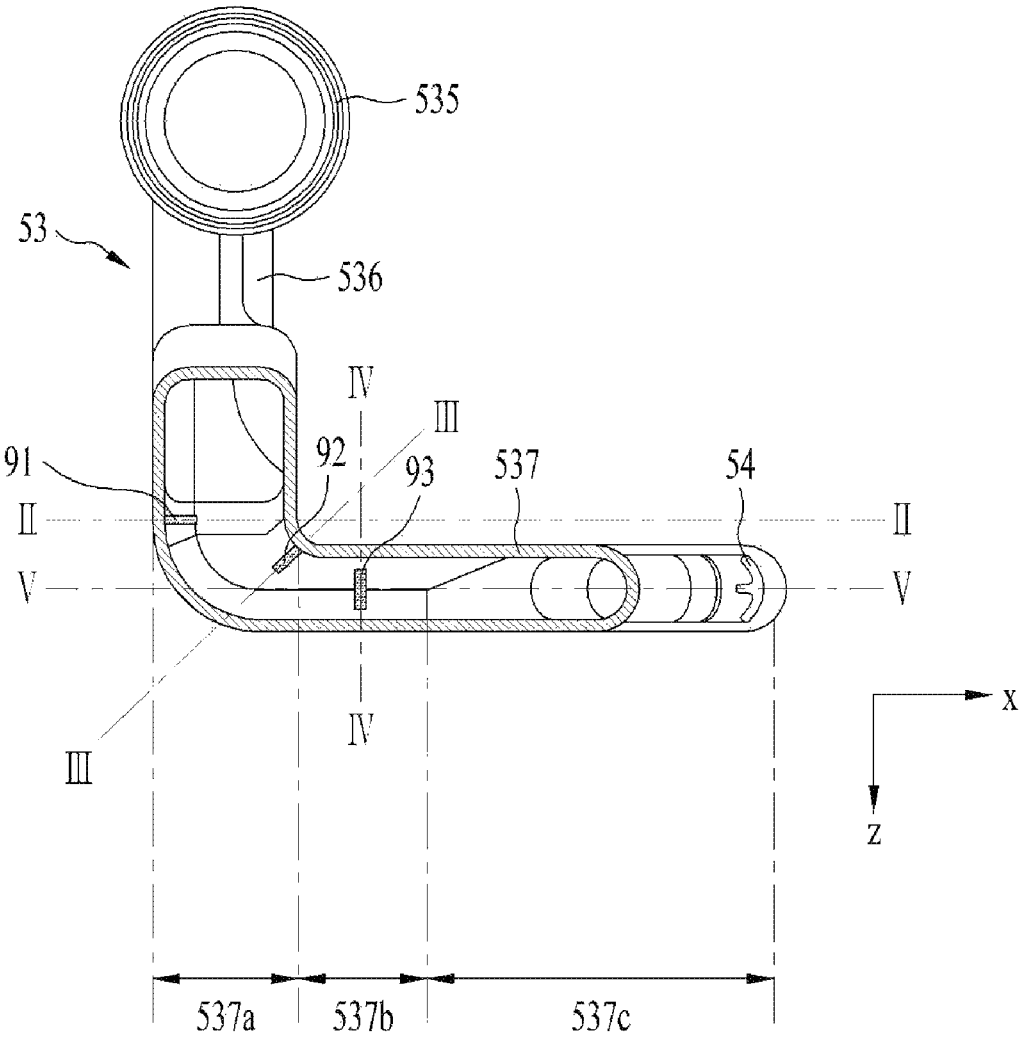
FIGS. 9 to 11B are diagrams showing one example of a first deceleration wall provided within a discharge pipe.

As shown in FIG. 9, the decelerating part may include first and second decelerating walls 91 and 92 provided within the curved part 537*a* to form a zigzagged flow path.

The first decelerating wall 91 may be provided to a surface having a big curvature radius in a curved surface formed by the curved part 537*a* along a height direction (i.e., Y-axis direction) of the cabinet, and the second decelerating wall 92 may be provided to a surface having a small curvature radius in a curved surface formed by the curved part 537*a* along the height direction (i.e., Y-axis direction) of the cabinet.

Alternatively, unlike FIG. 9, the first decelerating wall 91 may be provided to a surface having a small curvature radius in a curved surface formed by the curved part 537*a* along a height direction (i.e., Y-axis direction) of the cabinet, and the second decelerating wall 92 may be provided to a surface having a big curvature radius in a curved surface formed by the curved part 537*a* along the height direction (i.e., Y-axis direction) of the cabinet.

Yet, if the first decelerating wall 91 and the second decelerating wall 92 are sequentially provided toward the horizontal part 537*b* from the trap forming pipe 536, as an amount of water moving along a surface having a big curvature radius in the curved surface formed by the curved part 537*a* will be greater than an amount of water moving along a surface having a small curvature radius, the first and second decelerating walls 91 and 92 are preferably disposed as shown in FIG. 9.

The decelerating part provided to the laundry treating apparatus may further include at least one of a third decelerating wall 93 projected from a floor surface of the horizontal part 537*b* toward the height direction (i.e., Y-axis direction) of the cabinet and a fourth decelerating wall (not shown) projected from a floor surface of the inclined part 537*c* toward the height direction of the cabinet.

Main functions of the third decelerating wall 93 and the fourth decelerating wall (not shown) are to decrease a flow speed, whereas main functions of the first and second decelerating walls 91 and 92 are to send the water discharged from the trap forming pipe 536 back to the trap forming pipe.

Thus, the third decelerating wall 93 and the fourth decelerating wall are configured to be projected from the floor surfaces of the horizontal part 537*b* and the inclined part 537*c*, respectively. Namely, since the speed of water is lowered after passing the first and second decelerating walls 91 and 92, the wall provided to the floor surface of the horizontal part 537*b* or the inclined part 537*c* will be more effective in decreasing the flow speed than a lateral side of the horizontal part 537*b* or the inclined part 537*c*.

Figure 10A:
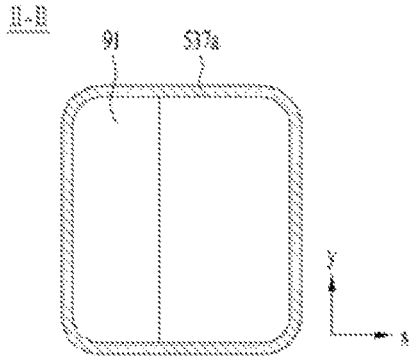
Figure 10B:
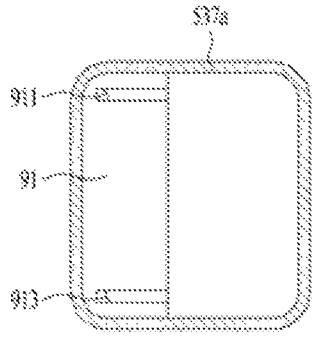
Figure 10C:
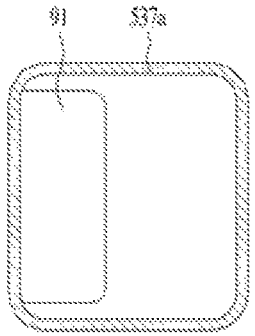

FIGS. 10A to 10C show a shape of the first decelerating wall 91. As shown in FIG. 10A, the first decelerating wall 91 may include a wall extending from the floor surface of the curved part 537*a* toward top side. Yet, it is highly probable that the first decelerating wall 91 in the shape shown in FIG. 10A will be broken or damaged in molding the discharge pipe 53. Namely, in order to form the first decelerating wall shown in FIG. 10A, a second mold forming the first decelerating wall 91 is inserted in a first mold forming the circumference of the curved part 537*a*, material is injected between the two molds, the second mold is then taken out of the first mold after the material has been hardened. Yet, if the second mold is taken out of the first mold in a state that the first decelerating wall has been formed, the first decelerating wall 91 may be torn by the second mold.

To prevent such a problem, a cut portion 911 and 913 may be further provided to at least one of a top end and bottom end of the first decelerating wall 91 along a width direction (i.e., X-axis direction) of the first decelerating wall 91. FIG. 10B shows one example of a case that a top cut portion 911 and a bottom cut portion 913 are provided to a top region and a bottom region of the first decelerating wall 91, respectively.

As shown in FIG. 10C, a top end of the first decelerating wall 91 may be spaced apart from a top surface of the curved part 537*a* and a bottom end of the first decelerating wall 91 may be spaced apart from a bottom surface of the curved part 537*a*.

When the second mold is taken out of the first mold, as the first decelerating wall 91 having the structure of FIG. 10B or FIG. 10C may be rotated or deformed, the problem of damaging or breaking the first decelerating wall in removing the mold can be solved.

Figure 11A:
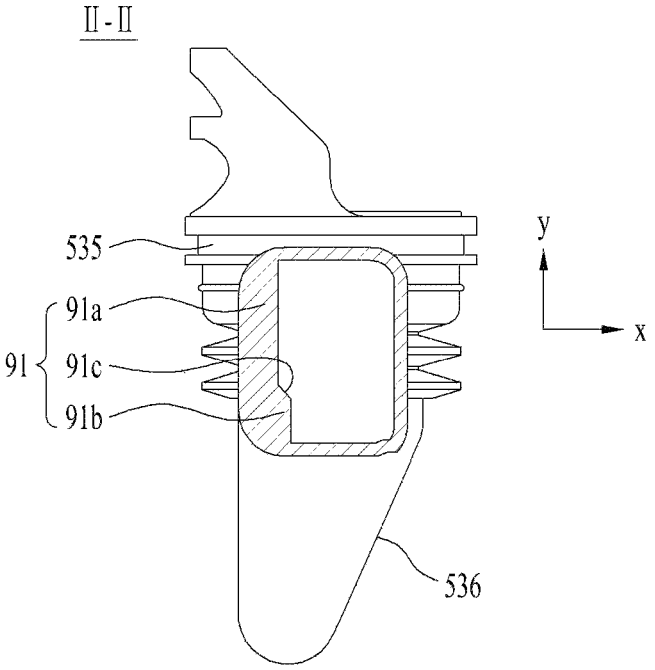
Figure 11B:
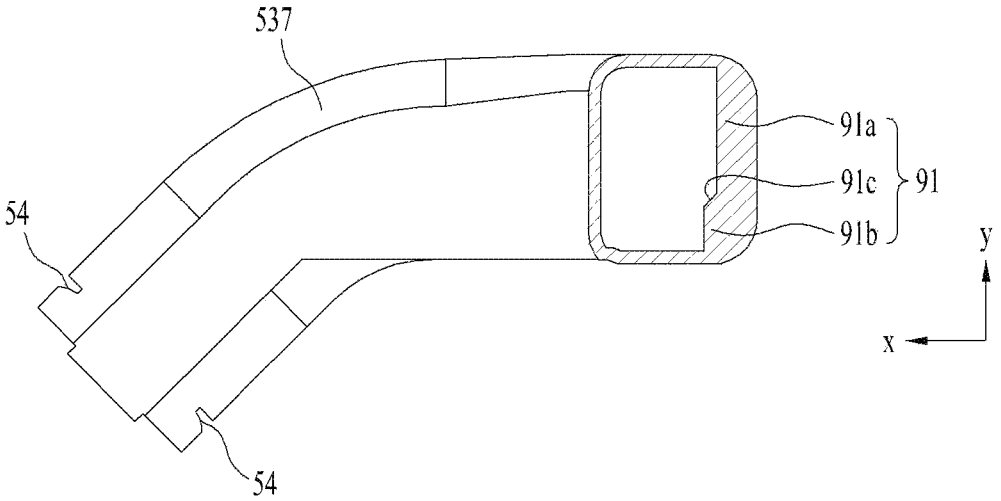

Furthermore, the first decelerating wall 91 may be configured in the shape shown in FIGS. 11A and 11B. Namely, a first step difference 91*c* formed along a height direction (i.e., Y-axis direction) of the curved part may be provided to a free end of the first decelerating wall 91. In this case, the first decelerating wall 91 may include a first top wall 91*a* connected to a top side of the curved part 573*a* and a bottom wall 91*b* fixed to a floor surface of the curved part 537*a* and having a width different from that of the first top wall. And, the first step difference 91*c* may be configured to connect a free end of the first top wall and a free end of the first bottom wall together.

Figure 12A:
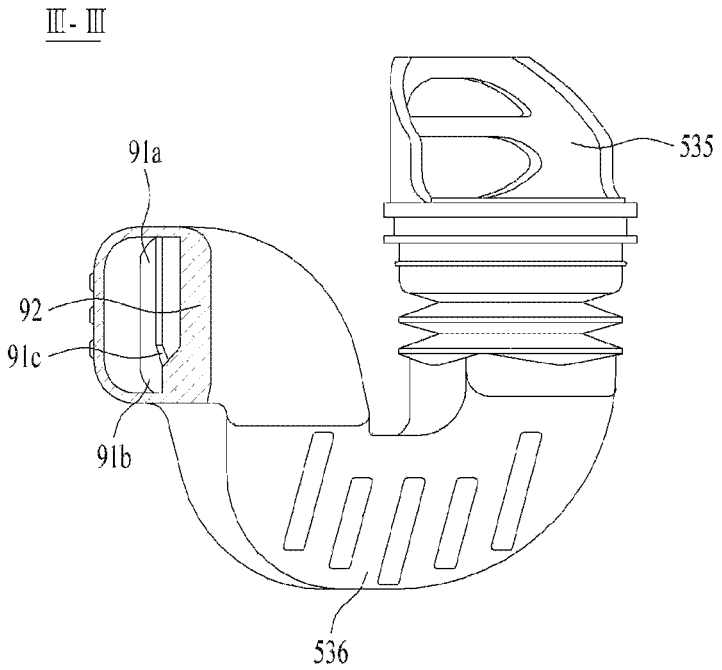
FIGS. 12A and 12B are diagrams showing one example of a second deceleration wall provided to a laundry treating apparatus.
Figure 12B:
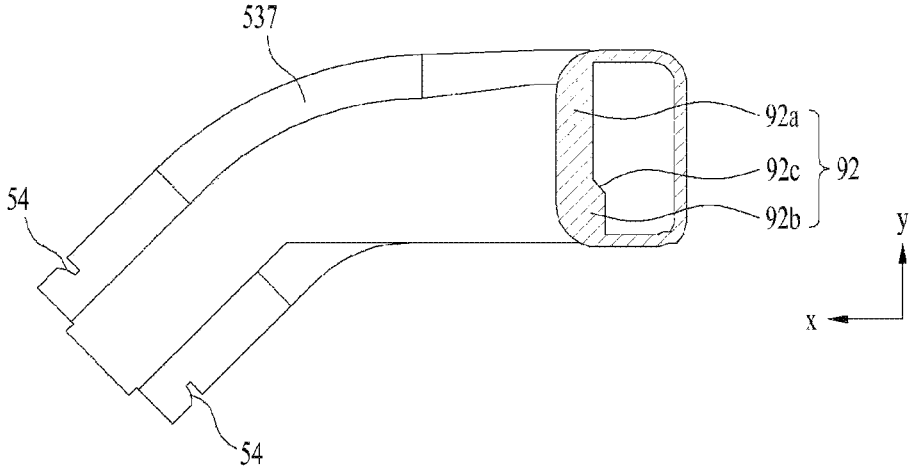

Although FIGS. 11A and 11B are described with reference to the first decelerating wall 91, the structure shown in FIGS. 11A and 11B is preferably applicable to the second decelerating wall 92. Namely, as shown in FIGS. 12A and 12B, the second decelerating wall 92 may include a second top wall 92*a* connected to the top side of the curved part 537*a*, a second bottom wall 92*b* fixed to the floor surface of the curved part 537*a* and having a width different from that of the second top wall, and a second step difference 92*c* connecting a free end of the second top wall and a free end of the second bottom wall together.

Figure 13A:
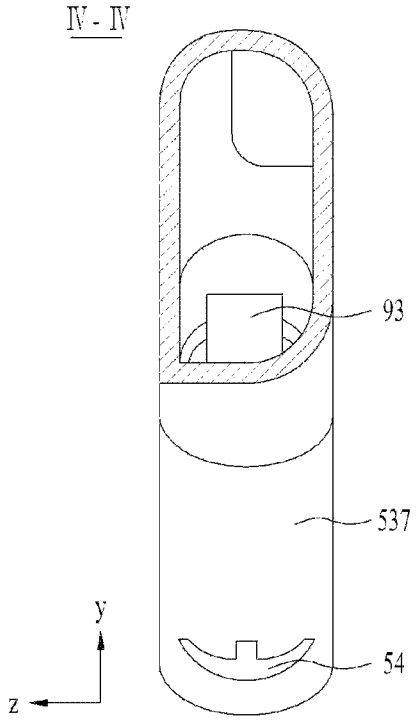
FIGS. 13A and 13B are diagrams showing one example of a third deceleration wall provided to a laundry treating apparatus.
Figure 13B:
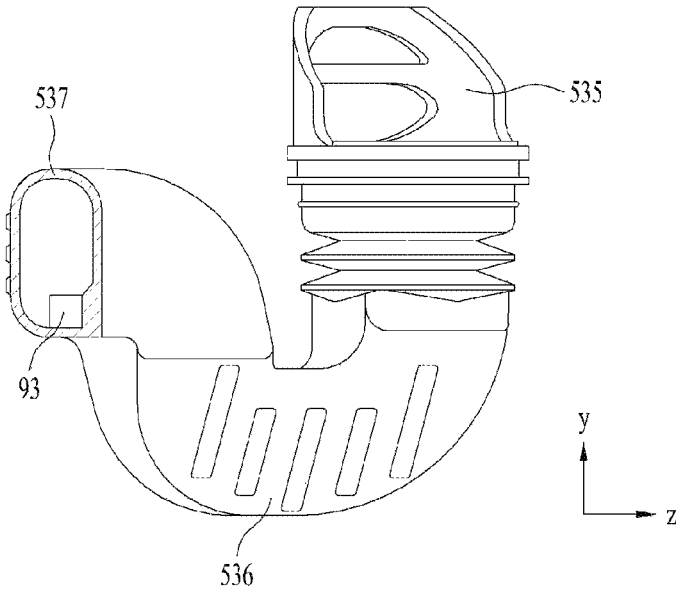
Figure 14A:
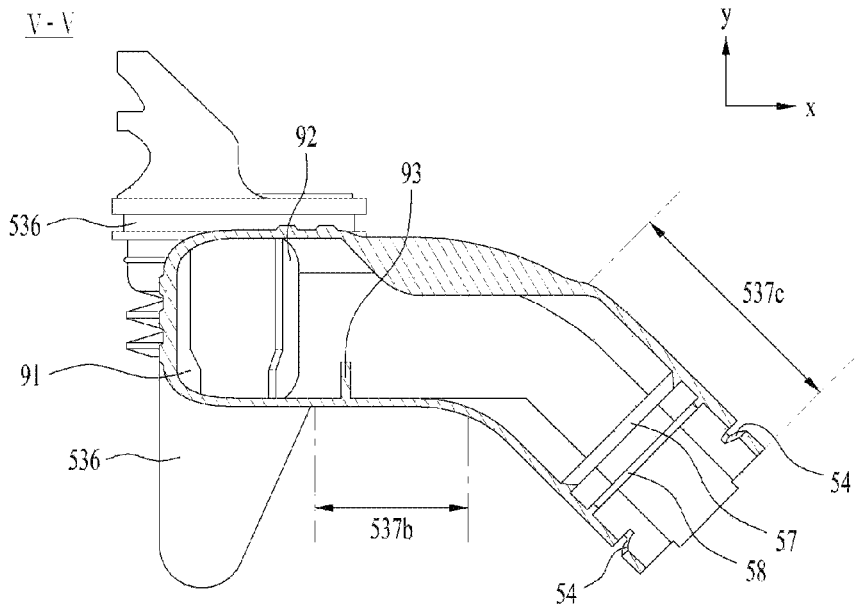
FIGS. 14A and 14B are diagrams showing one example of a connector stopper and a sealing part provided to a laundry treating apparatus.
Figure 14B:
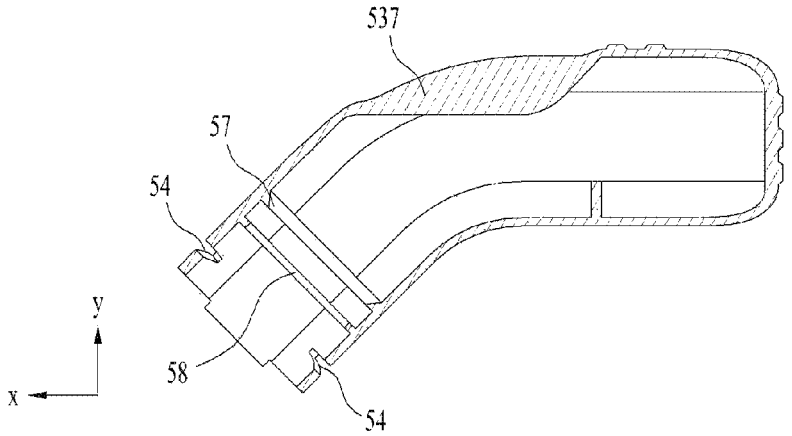

As shown in FIGS. 13A and 13B, the third decelerating wall 93 may be configured in a manner of being projected from a floor surface of the horizontal part 537*b* toward the top side of the horizontal part 537*b*. As shown in FIGS. 14A and 14B, a length of the third decelerating wall 93 is set to a length that prevents a top end (i.e., a free end) of the third decelerating wall 93 from contacting with the top side of the horizontal part 537*b*.

The structures of the walls shown in FIG. 10A to FIG. 11B are applicable to the third decelerating wall 93 as well. Namely, both ends of a width direction (i.e., Z-axis direction) of the third decelerating wall 93 may be configured not to be fixed to both lateral sides of the horizontal part 537*b*, and both ends of the third decelerating wall 93 may be configured to have a step difference provided to a top end while both ends of the third decelerating wall 93 are fixed to both lateral sides of the horizontal part 537*b*.

In case that a fourth decelerating wall is provided to the inclined part 537*c*, which is not shown in the drawing, the structure of the wall shown in FIG. 10A to FIG. 11B is applicable to the fourth decelerating wall as well. Namely, both ends of the fourth decelerating wall in a width direction (i.e., Z-axis direction) may be configured to be spaced apart from both ends of the inclined part 537*c*, or the fourth decelerating wall may be configured in a shape that both ends of the fourth decelerating wall are fixed to both lateral sides of the inclined part 537*c* and that a step difference is provided to a top end of the fourth decelerating wall.

The first to third decelerating walls 91 to 93 may be formed of the same material of the discharge pipe 53. Hence, if the discharge pipe 53 is formed of rubber, the first to third decelerating walls 91 to 93 will be formed of rubber as well.

When the door 135 opens the entrance 131, in order to minimize that a flow of water moving from the trap forming pipe 536 to the insulating body 41 is checked externally, the laundry treating apparatus 100 may further include a connecting flow path 44 (see FIG. 3) guiding water flowing along the guide 43 of the insulating body to the connecting body 415.

Figure 15:
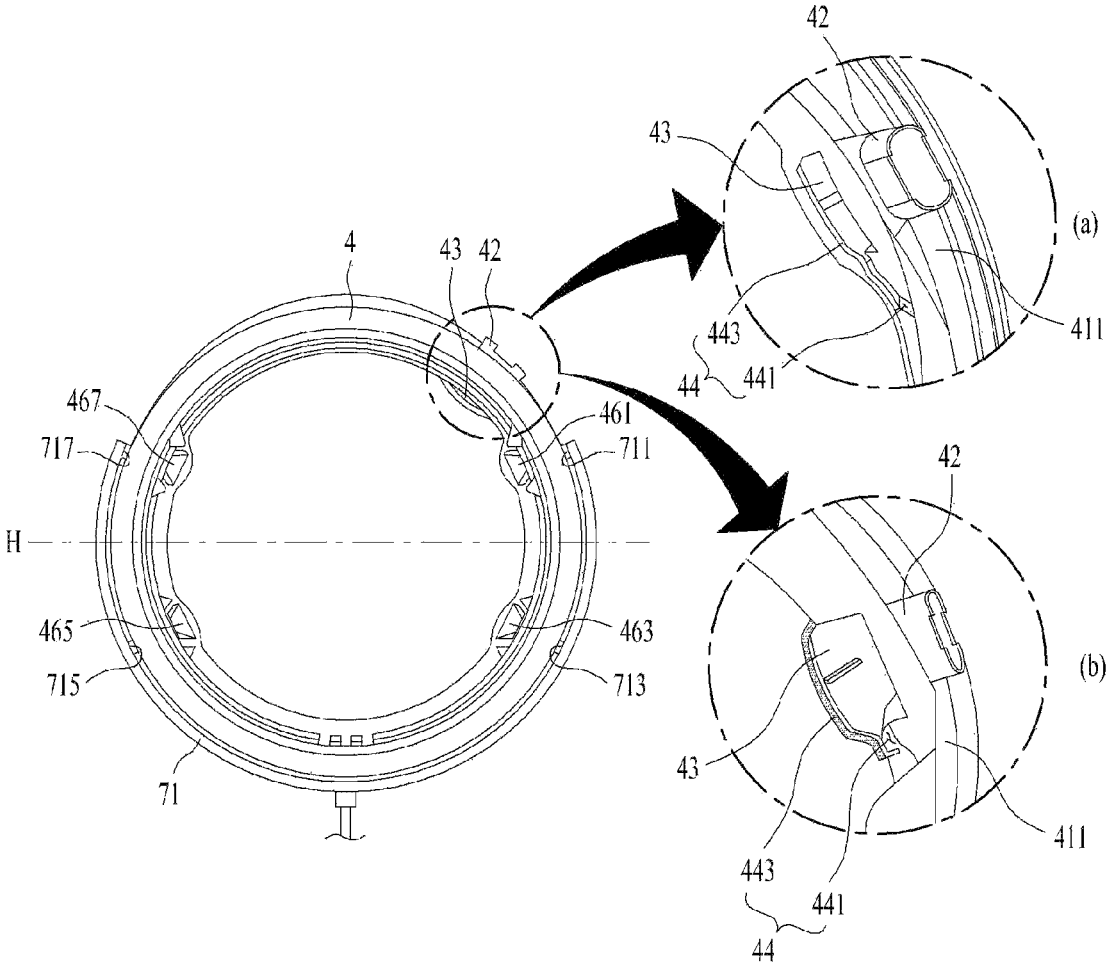
FIG. 15 is a diagram showing one example of a connecting flow path guiding water discharged from a trap forming pipe to a connecting body.

FIG. 15 shows a backside of the insulating part 4. As shown in FIG. 15, the connecting flow path may include a recess 441 connecting an inner space of the guide 43 to the connecting body 415.

The guide 43 is provided to a space located over a horizontal line H that passes through a rotation center of the drum in a space provided by the first fixing body 411. Hence, liquid moving along the guide 43 at the speed below a reference speed (e.g., a speed at which liquid is separated from a surface of the guide) moves toward an edge of the guide 43 and will be then supplied to the connecting body 415 through the recess 441. The liquid supplied to the connecting body 415 moves to the tub body 21 through the communicating pipe 47 located in the bottom space of the connecting body. Therefore, through the aforementioned recess 441, the laundry treating apparatus can minimize that the water discharged from the trap forming pipe 536 is visually checked.

The connecting flow path 44 provided to the laundry treating apparatus may further include a recess guide 443 provided to an edge of the guide 43 to guide liquid in the guide 43 to the recess 441.

As shown in FIG. 15(*a*), the recess guide 443 may include a wall provided along the edge of the guide 43 and projected from the edge of the guide 43 toward the first fixing body 441. Alternatively, the recess guide 443 may include a wall provided along the edge of the guide 43 and projected from the edge of the guide 43 toward a direction in which the tub entrance 23 is located [see FIG. 15(*b*)].

It will be appreciated by those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An apparatus for treating laundry, the apparatus comprising:

a cabinet defining an entrance;

a door configured to open and close the entrance;

a tub located in the cabinet and configured to receive water, the tub defining a tub entrance that faces the entrance;

a drum rotatably provided inside the tub, the drum defining a space for storing the laundry therein and further defining a drum entrance that faces the entrance;

an insulating part that connects the entrance and the tub entrance, comprising:

a first fixing body that has a cylindrical shape and is fixed to the entrance, a second fixing body that has a cylindrical shape and is fixed to the tub entrance, a connecting body that connects the first and second fixing bodies together and that defines a space between the first fixing body and the second body for storing liquid, and an inflow pipe that passes through the first fixing body;

a storage part that is located in the cabinet and that defines a space configured to store detergent;

a storage part connecting pipe connected to the storage part and configured to discharge the detergent stored in the storage part;

an insulating part connecting pipe connected to the inflow pipe;

a trap forming pipe that connects the storage part connecting pipe with the insulating part connecting pipe, the trap forming pipe being a P-trap, a U-trap, or an S-trap; and a decelerating part located on the insulating part connecting pipe and configured to decelerate a flow speed of water that moves from the trap forming pipe to the insulating part connecting pipe, wherein the decelerating part comprises a first decelerating wall and a second decelerating wall that are located inside the insulating part connecting pipe to form a zigzagged path inside the insulating part connecting pipe.

2. The apparatus of claim 1, wherein the trap forming pipe and the insulating part connecting pipe defines an angle in a range from 90 degree to 120 degree in a plane oriented parallel to a floor surface of the cabinet.

3. The apparatus of claim 2, wherein the cabinet comprises:

a front panel at a front side of the cabinet that defines the entrance;

a rear panel at a rear side of the cabinet; and a first lateral panel and a second lateral panel that each connect the front panel with the rear panel, wherein the insulating part connecting pipe is oriented parallel to a width direction of the front panel, and the trap forming pipe is oriented parallel to a width direction of the first lateral panel.

4. The apparatus of claim 3, wherein the insulating part connecting pipe comprises:

a curved part connected to the trap forming pipe and located on an edge where the front panel and the first lateral panel are coupled together;

a horizontal part extended from the curved part along the width direction of the front panel; and an inclined part that connects the horizontal part with the inflow pipe and that is inclined from one end of the horizontal part toward a floor surface of the cabinet, wherein the first decelerating wall and the second decelerating wall that are located inside the curved part of the insulating part connecting pipe to define a zigzagged path inside the insulating part connecting pipe.

5. The apparatus of claim 4, wherein the first decelerating wall is located on a curved surface that is formed by the curved part of the insulator part connecting pipe and that has a first curvature radius along a height direction of the cabinet, and wherein the second decelerating wall is located on a curved surface that is formed by the curved part of the insulator part connecting pipe and that has a second curvature radius along the height direction of the cabinet, the second curvature radius being smaller than the first curvature radius.

6. The apparatus of claim 5, wherein the first decelerating wall is located closer to the trap forming part than the horizontal part in a space of the curved part of the insulating part connecting pipe, and wherein the second decelerating wall is located closer to the horizontal part than the trap forming part in the space of the curved part of the insulating part connecting pipe.

7. The apparatus of claim 4, wherein the first decelerating wall is located on a curved surface that is formed by the curved part of the insulator part connecting pipe and that has a first curvature radius along a height direction of the cabinet, and wherein the second decelerating wall is located on a curved surface that is formed by the curved part of the insulator part connecting pipe and that has a second curvature radius along the height direction of the cabinet, the second curvature radius being larger than the first curvature radius.

8. The apparatus of claim 7, further comprising a third decelerating wall oriented perpendicular to a floor surface of the horizontal part of the insulating part connecting pipe and along the height direction of the cabinet.

9. The apparatus of claim 8, further comprising a fourth decelerating wall oriented perpendicular to a floor surface of the inclined part of the insulating part connecting pipe and along the height direction of the cabinet.

10. The apparatus of claim 7, wherein a top end of the first decelerating wall is spaced from a top surface of the curved part of the insulating part connecting pipe, and wherein a bottom end of the first decelerating wall is spaced from a bottom surface of the curved part of the insulating part connecting pipe.

11. The apparatus of claim 7, wherein one or more cut portions are located along a width direction of the first decelerating wall and located at at least one of a top end or a bottom end of the first decelerating wall.

12. The apparatus of claim 7, wherein the first decelerating wall comprises a top wall connected to a top surface of the curved part of the insulating part connecting pipe and a bottom wall connected to a floor surface of the curved part of the insulating part connecting pipe, and wherein a width of the top wall is different from a width of the bottom wall.

13. The apparatus of claim 1, further comprising a discharge pipe connected to the storage part and configured to guide the liquid and detergent to move to the inflow pipe, wherein the inflow pipe and the discharge pipe are formed of elastic materials configured to restrict the transmission of vibrations.

14. The apparatus of claim 13, further comprising a connector that configured to connect the inflow pipe with the discharge pipe, the connector comprising:

a connector body that has a cylindrical shape, wherein one end of the connector body is inserted into the discharge pipe and the other end of the connector body is inserted into the inflow pipe; and a perforated hole that perforates the connector body and configured to guide the liquid and detergent to move to the inflow pipe.

15. The apparatus of claim 14, wherein the connector body comprises:

a first face;

a second face located opposite to the first face;

a third face that connects one end of the first face with one end of the second face; and a fourth face that connects the other end of the first face with the other end of the second face, wherein the third face and the fourth face are located opposite to each other.

16. The apparatus of claim 15, wherein the third face and the fourth face are curved surfaces and have a same curvature radius.

* * * * *